United States Patent [19]

Uehara et al.

[11] 4,248,574

[45] Feb. 3, 1981

[54] HYDRAULIC CONTROL SYSTEM FOR VARIABLE DISPLACEMENT PUMPS

[75] Inventors: Kazuo Uehara, Tokyo; Hideaki Tohma, Yokohama; Yoshito Sato, Hirakata, all of Japan

[73] Assignee: Kabushiki Kaisha Komatsu Seisakusho, Toyko, Japan

[21] Appl. No.: 78,030

[22] Filed: Sep. 24, 1979

[30] Foreign Application Priority Data

Sep. 22, 1978 [JP] Japan ..... 53-116019

[51] Int. Cl.[3] ..... F04B 49/00

[52] U.S. Cl. ..... 417/216; 60/447; 60/486

[58] Field of Search ..... 417/216, 218-222; 60/445, 447, 449, 452, 430, 486

[56] References Cited

U.S. PATENT DOCUMENTS

| | | | |
|---|---|---|---|
| 3,732,036 | 5/1973 | Busbey et al. | 417/216 |
| 3,738,779 | 6/1973 | Hein et al. | 417/213 |
| 3,841,795 | 10/1974 | Ferre et al. | 417/216 |
| 3,935,706 | 2/1976 | Stevens | 417/218 X |
| 4,065,228 | 12/1977 | McMillan | 417/216 X |
| 4,203,712 | 5/1980 | Uehara | 60/452 X |

FOREIGN PATENT DOCUMENTS

| | | | |
|---|---|---|---|
| 55-1478 | 1/1980 | Japan | 417/216 |

*Primary Examiner*—Carlton R. Croyle
*Assistant Examiner*—Edward Look
*Attorney, Agent, or Firm*—Armstrong, Nikaido, Marmelstein & Kubovcik

[57] ABSTRACT

A hydraulic control system for variable displacement pumps, comprising at least two variable displacement pumps, a prime mover for driving the variable displacement pumps, a fixed displacement pilot pump driven by the common prime mover, a pressure compensating valve comprising a two-stage proportional pressure reducing valve and a negative proportional pressure reducing valve, the pressure compensating valve being connected to the variable displacement pumps and the fixed displacement pilot pump, and at least two servo boosters each being mechanically connected to the respective variable displacement pumps for controlling the displacement therefrom, the servo boosters being connected to the fixed displacement pilot pump and the pressure compensating valve and controlled thereby.

4 Claims, 4 Drawing Figures

HYDRAULIC CONTROL SYSTEM FOR VARIABLE DISPLACEMENT PUMPS

BACKGROUND OF THE INVENTION

This invention relates to a hydraulic system controlling the displacement of variable displacement pumps.

In the hydraulic system in which a variable displacement pump is driven by a prime mover such as a diesel engine, it is essentially required to make arrangement so as not to impose an excessive load on the prime mover and utilize the output of the prime mover effectively against a wide range of loading pressures.

For this reason, the displacement of variable displacement pump is controlled in such a manner as to match the total input torque of a plurality of variable displacement pumps simultaneously driven by the same prime mover with the rating output torque of the prime mover regardless the loading pressure of each of the variable displacement pumps.

In brief, the following relative formula is obtained between the delivery pressures and displacement of variable displacement pump and the rating output torque thereof.

$$Q = Q^* \propto \frac{Tr}{Pp + Pp^* + \ldots}$$

Where Pp, Pp* . . . are delivery pressures of variable displacement pumps, Q and Q* are displacements thereof and Tr is rating output torque thereof.

Heretofore, in order to effect the displacement control in a simple manner to satisfy the above formula, displacement controlling devices of a plurality of variable displacement pumps have been mechanically connected and approximately non-linear control given by the above formula has been made by multiple springs.

In this case, because flow rates of the fluid delivered by all variable displacement pumps are set always equal, when controlling actuators at extremely slow speeds or preventing generation of excessive pressures, an excessive volume of fluid is ineffectively delivered by the pumps. Therefore, a considerable amount of power has been wasted as heat losses.

Such unavoidable heat losses are attributable to mechanical connection of the displacement controlling devices of a plurality of variable displacement pumps.

Stating in brief, such heat losses can be avoided by rendering it possible to control the displacements of variable displacement pumps individually, allowing a necessary amount of fluid to be delivered and controlling the maximum displacement or volume of the fluid to be delivered by the pumps.

$$Q \leqq Q_{max},\ Q^* \leqq Q_{max},$$

$$Q_{max} \propto \frac{Tr}{Pp + Pp^* + \ldots}$$

The prior art devices employing multiple spring are liable to be subjected to external disturbances and have a big mechanical hysteresis, and so it has been difficult to achieve effective utilization of power.

For this reason, there is an embodiment of such device in which the displacements of individual variable displacement pumps are set by a servo type displacement varying device and the relationship represented by the aforementioned formula can be obtained approximately by controlling the pilot pressure of the displacement varying device.

This embodiment is disadvantageous in that the difference between the target value and the approximate value obtained is big and also smooth starting of the prime mover cannot be made because the displacement of the pump is set maximum when it is stopped. (The displacement of the pump reaches its maximum value when the pilot pressure is lowest).

SUMMARY OF THE INVENTION

It is therefore an object of the present invention to provide a hydraulic control system for variable displacement pumps which can overcome the above noted problems.

Another object of the present invention is to provide a hydraulic control system for variable displacement pumps which is capable of attaining a constant total input torque for a plurality of variable displacement pumps thereby preventing a prime mover for driving the pumps from being imposed an excessive load.

A further object of the present invention is to provide a hydraulic control system for variable displacement pumps wherein displacement volume therefrom becomes minimum when the pumps are not in operation thereby significantly improving a starting-up characteristic for the prime mover.

In accordance with an aspect of the present invention, there is provided a hydraulic control system for variable displacement pumps, comprising in combination at least two variable displacement pumps; prime mover means for driving said variable displacement pumps; a fixed displacement pilot pump driven by said prime mover means; pressure compensating valve means comprising two-stage proportional pressure reducing valve means and negative proportional pressure reducing valve means, said two-stage proportional pressure reducing valve means being connected to said variable displacement pumps and said fixed displacement pilot pump and adapted to increase output pressure therefrom when the sum of output pressures from said variable displacement pumps is increased while allowing the output pressure therefrom to be decreased when the sum of the output pressures from said variable displacement pumps is decreased, said negative proportional pressure reducing valve means being connected to said two-stage proportional pressure reducing valve means and said fixed displacement pilot pump and adapted to decrease output pressure therefrom when the output pressure from said two-stage proportional pressure reducing valve means is increased while allowing the output pressure therefrom to be increased when the output pressure from said two-stage proportional pressure reducing valve means is decreased;

at least two servo booster means each being connected to said respective variable displacement pumps for controlling the displacements therefrom, said servo booster means being connected to the output of said negative proportional pressure reducing valve means and said fixed displacement pilot pumps.

The above and other objects, features and advantages of the present invention will be readily apparent from the following description taken in conjunction with the accompanying drawings.

DETAILED DESCRIPTION OF THE INVENTION

Figure 1:
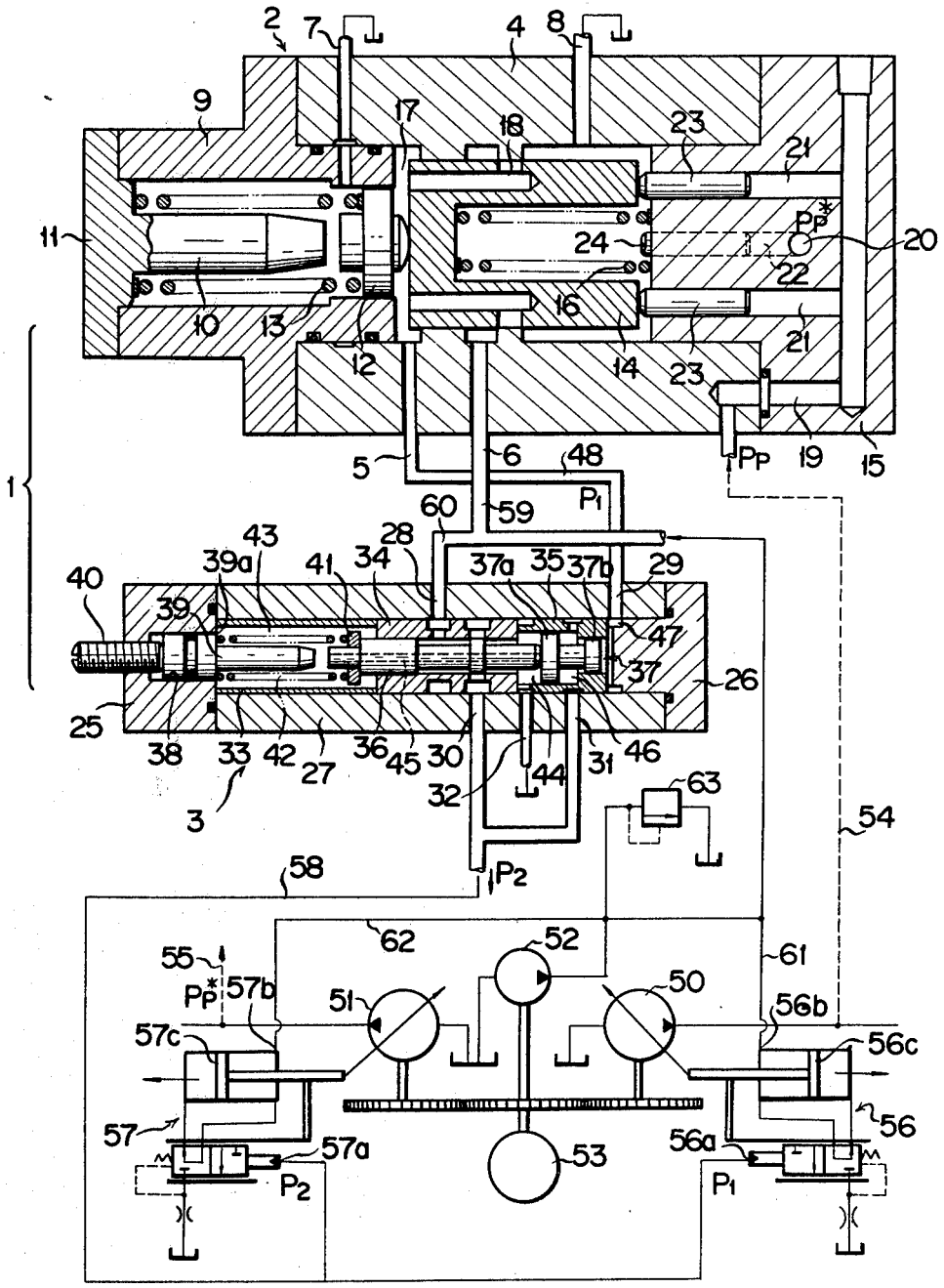
FIG. 1 is a hydraulic circuit for an overall hydraulic system of the present invention wherein a pressure compensating valve means comprising a two-stage proportional pressure reducing valve and a negative proportional pressure reducing valve is shown in cross-section.

The present invention will now be described below with reference to the accompanying drawings.

Reference numeral 1 denotes a pressure compensator valve which comprises a two-stage proportional pressure reducing valve 2 and a negative proportional pressure reducing valve 3.

The negative proportional pressure reducing valve as used herein is a pressure reducing valve wherein sum of the output pressure therefrom and the output pressure of two-stage proportional pressure reducing valve 2 is constant.

The two-stage proportional pressure reducing valve 2 comprises a housing 4 having ports 5 and 6 and drain ports 7 and 8 formed therein. Fitted to one end of the housing 4 is a cylindrical member 9. A cover member 11 having a stopper 10 is fitted to one end of the cylindrical member 9. A piston 12 is slidably mounted within the cylindrical member 9 and a spring 13 is interposed between the cover member 11 and the piston 12. The spring chamber defined within the cylindrical member 9 communicates with the drain port 7. A spool 14 is inserted in the housing 4 and a block 15 is fitted to the other end of the housing 4. A spring 16 is interposed between the block 15 and the spool 14 which abuts against the piston 12. A chamber 17 defined between the piston 12 and the spool 14 communicates with the port 5. The spool 14 has formed therein holes 18 which communicate the outer peripheral surface thereof with the chamber 17. The block member 15 has formed therein pump ports 19 and 20 which communicate with holes 21 and 22, respectively. Slidably mounted in the holes 21 and 22 are pins 23 and 24, respectively, which abut against the spool 14.

The negative proportional pressure reducing valve 3 comprises a housing 27 having plugs 25 and 26 fitted to both ends thereof. The housing 27 has ports 28, 29, 30 and 31 and a drain port 32 formed therein. A spacer 33 and sleeves 34, 35 are mounted in the housing 27. Slidably mounted in the sleeves 34 and 35 are a spool 36 and a piston 37, respectively.

Formed in the plug 25 is a cylinder 38 in which a movable stopper 39 is inserted. The movable stopper 39 can be moved or adjusted by means of an adjusting screw 40 threadably engaged with the plug 25. A spring 42 is interposed between a spring retainer **39*a* of the movable stopper 39 and a spring retainer 41 of the spool 36**.

The spool 36 has formed therein a passage 45 which communicates the spring chamber 43 with a chamber 44 defined between the spool 36 and the piston 37, the chamber 44 communicating with the drain port 32. The piston 37 has a large diameter portion **37*a* and a small diameter portion 37*b***.

A chamber 46 defined between the portions **37*a* and 37*b* communicates with the port 31, and a chamber 47 formed in the rear part of the small diameter portion 37*b* communicates with the port 29**.

Further, the port 5 of the two-stage proportional pressure reducing valve 2 communicates through a conduit 48 with the port 29 of the negative proportional pressure reducing valve 3.

In FIG. 1, reference numerals 50 and 51 denote variable displacement pumps, and 52 a fixed displacement pilot pump. These pumps 50, 51 and 52 are arranged to be driven by the same prime mover 53. The delivery side of the variable displacement pump 50 is connected through a delivery conduit 54 with the pump port 19 of the two-stage proportional pressure reducing valve 2, whilst the delivery side of another variable displacement pump 51 is connected through a delivery conduit 55 with the pump port 20.

The ports 30, 31 of the negative proportional pressure reducing valve 3 communicate through a conduit 58 with actuating ports **56*a* and 57*a* of servo boosters 56 and 57**, respectively.

The delivery side of the fixed displacement pilot pump 52 communicates through conduits 59 and 60 with the ports 6 and 28, respectively, of the pressure compensator valve 1, and also communicates through conduits 61 and 62 with ports **56*b* and 56*b* of the servo boosters 56 and 57, respectively. The servo boosters 56 and 57 are mechanically connected to swash plates of the variable displacement pumps 50 and 51, repectively. With movements of pistons 56*c* and 57*c* of the servo boosters 56 and 57 in the direction indicated by the arrows, the delivery volume of the variable displacement pumps 50 and 51 will increase. The delivery pressure Ps of the fixed displacement pilot pump 52 can be set by adjusting a relief valve 63**.

The displacement control device of the present invention will now be described below.

The delivery pressures Pp and Pp* of the variable displacement pumps 50 and 51 are applied to the chambers defined to the right hand of the pins 23 and 24. The pins 23 and 24, four pieces in total are located at equal angular intervals along the same circumference.

The delivery pressures Pp and Pp* are exerted to urge through the pins 23 and 24 the spool 14 together with the spring 16 to the left hand in the drawing. On the other hand, the spring 13 tends to urge through the piston 12 the spool 14 to the right hand.

As the sum of delivery pressures Pp+Pp* increases, the spool 14 is moved leftwards thereby allowing the port 6 to communicate with the port 5 so as to increase the pressure $P_1$ of the port 5.

Reversely, as the sum of delivery pressures Pp+Pp* decreases, the spool 14 is moved rightwards thereby cutting off the communication between the ports 5 and 6 and communicating the the port 5 with the drain port 8 so as to reduce the pressure $P_1$ of the port 5.

When the pressure $P_1$ is low and $P_1A_3 \leqq F_2$ (wherein $A_3$ is active area of the piston 12 and $F_2$ is set loading on the spring 13), the piston 12 is allowed to contact with the spool 14. Therefore, the condition for equilibrium can be expressed by the following formula.

$$P_1(A_2-A_3)+F_2=F_1+2A_1(Pp+Pp^*)$$

$$Pp + Pp^* \leqq \frac{A_2F_2 - A_3F_1}{2A_1A_3}$$

Wherein $F_1$: set loading on the spring 16

$A_1$: Active area of each of the pins 23 and 24

$A_2$: Active area of the spool 14

In the case the pressure $P_1$ is high and $P_1A_3 > F_2$, piston 12 is disengaged from the spool 14. Therefore, the condition for balancing is given by the following formula.

$$P_1A_2=F_1+2A_1(Pp+Pp^*),\ P_1 \leqq Ps$$

Figure 2:
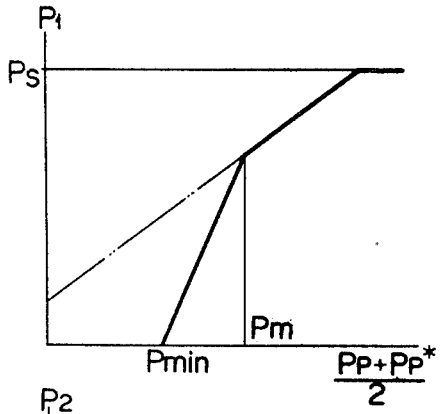
FIG. 2 is a diagram showing characteristic features of the two-stage proportional pressure reducing valve wherein Pp and Pp* are the output pressures from the variable displacement pumps, Ps is the output pressure from a fixed displacement pilot pump and $P_1$ is the output pressure from the two-stage proportional pressure reducing valve.

Therefore, the two-stage proportional pressure reducing valve 2 will develop the characteristics as shown in FIG. 2.

In brief, the characteristic of the two-stage proportional pressure reducing valve 2 can be given by the following representation.

$$P_{min} = \frac{F_2 - F_1}{4A_1}$$

$$P_m = \frac{A_2F_2 - A_3F_1}{4A_1A_3}$$

In FIG. 2, the pressure at the bending point can be adjusted by changing the value of $F_2$.

The output pressure $P_1$ of the two-stage proportional pressure reducing valve 2 is introduced through the port 29 into the right side chamber 47 of the piston 37 so as to urge the spool 36 leftwards against the biaing force of the spring 42. At the same time, the output pressure $P_2$ of the negative proportional pressure reducing valve 3 is applied through the port 31 to the chamber 46 of the piston 37 thereby urging the spool 36 leftwards in the similar manner.

As the pressure $P_1$ in the port 29 increases, the communication between the ports 28 and 30 is cut off and the port 30 is allowed to communicate with the drain port 32. Consequently, the pressure $P_2$ in the port 30 and the port 31 connected thereto will be reduced.

Reversely, as the pressure $P_1$ in the port 29 decreases, the spool 36 is moved rightwards by the force of the spring 42 thereby allowing the port 28 to communicate with the port 30 and cutting off the communication between the port 30 and the drain port 32 so as to increase the pressure $P_2$ in the ports 30 and 31.

The condition for balancing the negative proportional pressure reducing valve 3 can be given by the following formula.

$$A_4P_1+(A_5-A_4)P_2=F_3$$

$$P_1 \leqq Ps,\ P_2 \leqq Ps$$

where $A_4$: Active area of small diameter portion 37*b* of piston 37

$A_5$: Active area of large diameter portion 37*a* of piston 37

$F_3$: Set loading on spring 42

Figure 3:
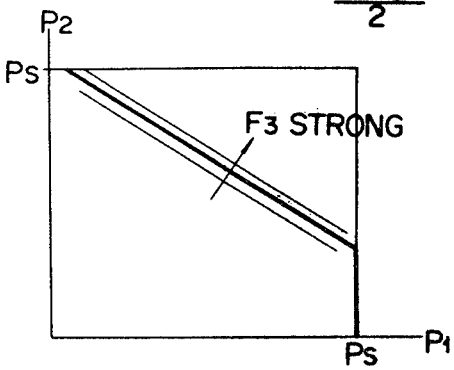
FIG. 3 is a diagram showing characteristic features of the negative proportional pressure reducing valve wherein $P_2$ is the output pressure therefrom and $F_3$ is the spring force of a compression spring mounted therein.

Accordingly, the negative proportional pressure reducing valve 3 will demonstrate the characteristics as shown in FIG. 3. The value of $F_3$ can be set by means of the adjusting screw 40 and matching of the variable displacement pumps 50 and 51 and the prime mover 53 can be easily made.

Figure 4:
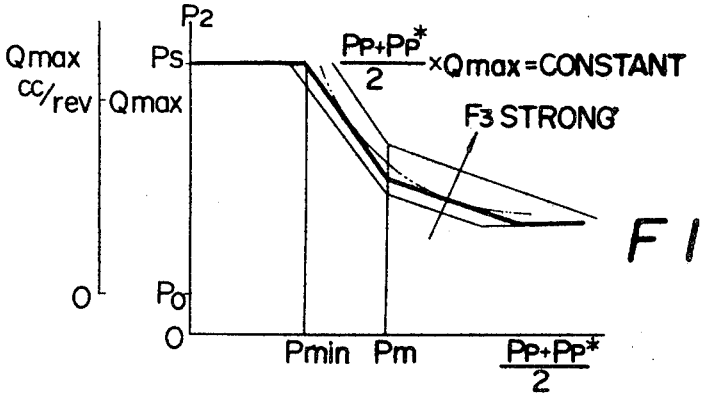
FIG. 4 is a diagram showing characteristic features of the pressure compensating valve composed in combination of the two-stage proportional pressure reducing valve and the negative proportional pressure reducing valve.

As mentioned above, the two-stage proportional pressure reducing valve 2 exhibits the characteristics shown in FIG. 2, whilst the negative proportional pressure reducing valve 3 demonstrates the characteristics shown in FIG. 3. Therefore, the characteristics of the pressure compensator valve 1 will be as shown in FIG. 4.

For this reason, the total input torque of the variable displacement pumps 50 and 51 will be approximately constant, and its control error will be smaller than that of a prior art device.

Further, since Ps is zero when the fixed displacement pilot pump 52 is stopped, $P_2$ becomes zero, and therefore the displacement of the variable displacement pumps will become minimum thereby enabling an improved starting-up characteristics to be obtained.

The output pressure $P_2$ of the aforementioned pressure compensator valve 1 is introduced as the pilot input for the servo boosters 56 and 57, and the control of the output pressure $P_2$ enables the servo boosters 56 and 57 to be actuated thereby controlling the displacement of the variable displacement pumps 50 and 51.

As mentioned hereinabove, the present invention is characterized by comprising a two-stage proportional pressure reducing valve 2 wherein the increase in the sum of delivery pressures Pp+Pp* of the variable displacement pumps 50 and 51 will increase the output pressure $P_1$ therefrom, whilst the decrease in the sum of delivery pressures Pp+Pp* will reduce the output pressure $P_1$, a negative proportional pressure reducing valve 3 wherein the increase in the output pressure $P_1$ of the reducing valve 2 will reduce the output pressure $P_2$ therefrom, whilst the decrease in the output pressure $P_1$ will increase the output pressure $P_2$, and servo boosters 56 and 57 adapted to receive the delivery pressure Ps of the pilot pump 52 and the output pressure $P_2$ of the negative proportional pressure reducing valve 3 as inputs for controlling the displacements of the variable displacement pumps 50 and 51.

Therefore, the total input torque of a plurality of variable displacement pumps can be kept constant so as not to apply excessive loading on the prime mover, and also the output of the prime mover can be utilized effectively against a wide range of loading pressures. Moreover, the displacement of the pump can be kept minimum when it is stopped, and therefore the starting-up characteristics of the prime mover can be remarkably improved.

It is to be understood that the foregoing description is merely illustrative of a preferred embodiment of the invention, and that the scope of the invention is not to be limited thereto, but is to be determined by the scope of the appended claims.

What we claim is:

1. A hydraulic control system for variable displacement pumps, comprising in combination:

at least two variable displacement pumps;

prime mover means for driving said variable displacement pumps;

a fixed displacement pilot pump driven by said prime mover means;

pressure compensating valve means comprising two-stage proportional pressure reducing valve means and negative proportional pressure reducing valve means, said two-stage proportional pressure reducing valve means being connected to said variable displacement pumps and said fixed displacement pilot pump and adapted to increase output pressure therefrom when the sum of output pressures from said variable displacement pumps is increased while allowing the output pressure therefrom to be decreased when the sum of the output pressures from said variable displacement pumps is decreased, said negative proportional pressure reducing valve means being connected to said two-stage proportional pressure reducing valve means and said fixed displacement pilot pump and adapted to decrease output pressure therefrom when the output pressure from said two-stage proportional pressure reducing valve means is increased while allowing the output pressure therefrom to be increased when the output pressure from said two-stage proportional pressure reducing valve means is decreased;

at least two servo booster means each being connected to said respective variable displacement pumps for controlling the displacements therefrom, said servo booster means being connected to the output of said negative proportional pressure reducing valve means and said fixed displacement pilot pump.

2. A hydraulic control system as recited in claim 1 wherein said two-stage proportional pressure reducing valve means comprises:

a housing having a bore and a first and a second ports formed therein;

a cylindrical cap member fixedly secured to one end of said housing, said cylindrical cap member having a first spring chamber formed therein;

a plug member fixedly secured to the other end of said housing, said plug member having at least two pump ports and a plurality of pin holes formed therein, said pin holes being communicated with said pump ports;

a plurality of pins each slidably inserted within said respective pin holes;

a spool slidably mounted within the bore of said housing, said spool having a second spring chamber formed therein;

a piston slidably mounted within said first spring chamber defining a hydraulic fluid chamber formed between said first piston and one end of said spool;

first spring means accommodated within said first spring chamber for urging said piston toward said spool; and second spring means accommodated within said second spring chamber for urging said spool toward said piston wherein said pump ports are connected to said variable displacement pumps, said first port is connected to said fixed displacement pilot pump and said negative proportional pressure reducing valve means, and said second port is communicated with said hydraulic fluid chamber and connected to said negative proportional pressure reducing valve means whereby said first port is selectively communicated with said second port.

3. A hydraulic control system as recited in claim 1 or 2 wherein said negative proportional pressure reducing valve means comprises:

a housing having a bore, a first, a second and a third ports formed therein;

a first plug member fixedly secured to one end of said housing;

a second plug member fixedly secured to the other end of said housing;

a first and a second sleeves mounted within the bore of said housing;

a spool slidably mounted within said first sleeve defining a spring chamber formed between said first plug member and said spool;

a piston slidably mounted within said second sleeve defining a second hydraulic fluid chamber between one end of said piston and said second plug member; and spring means accommodated within said spring chamber for urging said spool toward said piston wherein said first port is communicated with said second hydraulic fluid chamber and connected to said two-stage proportional pressure reducing valve means, said second port is connected to said fixed displacement pilot pump and said two-stage proportional pressure reducing valve means, and said third port is connected to said servo booster means whereby said second port is selectively communicated with said third port.

4. A hydraulic control system as recited in claim 3 wherein said housing of said negative proportional pressure reducing valve means has formed therein a fourth port and wherein said piston of said negative proportional pressure reducing valve means has a larger diameter land portion and a smaller diameter land portion defining a third hydraulic fluid chamber formed therebetween, said fourth port being communicated with said third chamber and connected to said third port.

* * * * *